US011598564B2

(12) United States Patent
Fonte

(10) Patent No.: US 11,598,564 B2
(45) Date of Patent: Mar. 7, 2023

(54) REFRIGERATION SYSTEM

(71) Applicant: Carrier Corporation, Palm Beach Gardens, FL (US)

(72) Inventor: Nicolas Fonte, Montluel (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 145 days.

(21) Appl. No.: 17/127,495

(22) Filed: Dec. 18, 2020

(65) Prior Publication Data

US 2021/0190401 A1 Jun. 24, 2021

(30) Foreign Application Priority Data

Dec. 19, 2019 (EP) ..... 19218293

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2345/003* (2013.01); *F25B 2345/006* (2013.01); *F25B 2400/16* (2013.01); *F25B 2500/23* (2013.01); *F25B 2600/2513* (2013.01); *F25B 2700/2103* (2013.01)

(58) Field of Classification Search
CPC ..... F25B 45/00; F25B 49/02; F25B 2700/21163; F25B 2700/2103; F25B 2600/2513; F25B 2500/23; F25B 2400/16; F25B 2345/006; F25B 2345/003
See application file for complete search history.

(56) References Cited

U.S. PATENT DOCUMENTS

| | | | | |
|---|---|---|---|---|
| 10,345,021 | B2 | 7/2019 | Uselton | |
| 2008/0190130 | A1* | 8/2008 | Murakami | F25B 13/00 62/324.3 |
| 2017/0115043 | A1* | 4/2017 | Laughman | F25B 49/02 |
| 2018/0010833 | A1 | 1/2018 | Sibik | |
| 2018/0252449 | A1* | 9/2018 | Ito | F25B 49/02 |

FOREIGN PATENT DOCUMENTS

| | | | |
|---|---|---|---|
| DE | 102014203578 | A1 | 8/2015 |
| EP | 3361184 | A1 | 8/2018 |
| WO | 2006128262 | A2 | 12/2006 |
| WO | 2017069281 | A1 | 4/2017 |

OTHER PUBLICATIONS

European Search Report for Application No. 19218293.9; dated Jul. 8, 2020; 7 Pages.

* cited by examiner

*Primary Examiner* — Henry T Crenshaw
(74) *Attorney, Agent, or Firm* — Cantor Colburn LLP

(57) ABSTRACT

A refrigeration system includes a main refrigeration circuit for holding refrigerant fluid, the main refrigeration circuit including: a compression device 12, a heat rejecting heat exchanger 14, an expansion device 18 and a heat absorbing heat exchanger 16. In addition, the refrigeration system includes a buffer tank 20 attached to the main refrigeration circuit, with valves 22, 24 for controlling flow of refrigerant fluid between the main refrigeration circuit and the buffer tank 20. The refrigeration system is arranged such that the valves 22, 24 are controlled to transfer refrigerant fluid between the main refrigeration circuit and the buffer tank 20 based on a measure of sub-cooling in the main refrigeration circuit.

12 Claims, 1 Drawing Sheet

REFRIGERATION SYSTEM

FOREIGN PRIORITY

This application claims priority to European Patent Application No. 19218293.9, filed Dec. 19, 2019, and all the benefits accruing therefrom under 35 U.S.C. § 119, the contents of which in its entirety are herein incorporated by reference.

TECHNICAL FIELD

The present invention relates to a refrigeration system and a method for operating a refrigeration system.

BACKGROUND

As is well known, refrigeration or heating can be provided by a refrigeration system making use of the refrigeration cycle, in which a refrigerant fluid is compressed, cooled, expanded and then heated. In one common usage, where such a refrigeration system is used for satisfying a cooling load, the cooling of the refrigerant fluid is done via a heat rejection heat exchanger rejecting heat to the atmosphere and the heating of the refrigerant fluid is done via a heat absorbing heat exchanger that absorbs heat from an object to be cooled, such as a refrigerated space for low temperature storage, or an interior of a building to be occupied by people. In this way the refrigeration system can transfer heat from within the building to outside of the building even when the interior is cooler than the atmosphere. Alternatively, a refrigeration system can be used as a heat pump to satisfy a heat demand. In that case by the heat absorbing heat exchanger is used to absorb heat from a low temperature source, with the refrigeration circuit then rejecting heat to a higher temperature object that is to be heated. Once again this may be the interior of a building. In both cases a full or partial phase change of the refrigerant fluid can be used to increase the possible temperature differential between the heat rejection and heat absorption stages.

It will be appreciated that the ability of the refrigeration system to correctly handle the refrigerant fluid is important in terms of achieving the most effective operation of the refrigeration cycle. In particular, it is important to optimise the handling of refrigerant fluid within a main refrigeration circuit for the compression, cooling, expansion and heating of the refrigerant fluid. In this context it is known to determine optimal refrigerant type and refrigerant charge levels to increase efficiency of the refrigerant system. It always remains the case that increases in efficiency and utility are desirable.

SUMMARY

Viewed from a first aspect, the invention provides a refrigeration system comprising: a main refrigeration circuit for holding refrigerant fluid, the main refrigeration circuit including: a compression device, a heat rejecting heat exchanger, an expansion device and a heat absorbing heat exchanger; wherein the refrigeration system includes a buffer tank attached to the main refrigeration circuit, with valves for controlling flow of refrigerant fluid between the main refrigeration circuit and the buffer tank; and wherein the refrigeration system is arranged such that the valves are controlled to transfer refrigerant fluid between the main refrigeration circuit and the buffer tank based on a measure of sub-cooling in the main refrigeration circuit.

With the use of a buffer tank and controllable valves it becomes possible to vary the refrigerant charge level of the main refrigeration circuit in order to allow for increased efficiency during changes in operating conditions, as well as increased refrigerant capacity, the potential to enlarge the operating envelope of the refrigerant system, and other enhancements including greater robustness over time as refrigerant charge is depleted. As noted above, it is known to determine optimal refrigerant charge levels to allow for increased efficiency. Often this is done with reference to an optimal sub-cooling value linked with parameters of the compression device and operating conditions of the refrigerating system, such as temperatures of heat absorption and/or heat rejection. During operation of the refrigeration system conditions vary, but in traditional closed refrigeration circuits the charge level is fixed. The system of the first aspect may advantageously make use of the buffer tank to vary the refrigerant charge levels in the main refrigeration circuit in order to achieve efficiency increases for varying operating conditions. Whilst other systems have been proposed for achieving some of these benefits, these are generally more costly and complex, such as via introducing additional heat exchangers and/or sub-circuits with added drivers (i.e. added compressors or pumps). The proposed buffer tank system gives numerous advantages with a relatively simple and inexpensive modification to the refrigeration system.

The buffer tank provides a receiver/reservoir for the refrigerant fluid and may hence be implemented using components known for use as refrigerant receivers. The buffer tank may be connected to the main refrigeration circuit via a first valve for controlling flow to or from a higher pressure point on the refrigerant circuit and a second valve for controlling flow to or from a lower pressure point on the refrigerant circuit. When a refrigerant pressure in the buffer tank is lower or higher than a refrigerant pressure in the main refrigeration circuit then opening the respective valve will allow for transfer of refrigerant fluid to or from the buffer tank. For example, when it is desired to decrease charge levels in the main refrigeration circuit then the first valve may be opened to fill the buffer tank from the higher pressure point, and when it is desired to increase charge levels in the main refrigeration circuit then the second valve may be opened to empty the buffer tank to the lower pressure point.

In one example, the buffer tank is connected to the main refrigeration circuit in parallel with the expansion device, with fluid connections to a higher pressure point prior to expansion, and a lower pressure point after expansion. Thus, with first and second valves as discussed above the first valve may be in a fluid line between the buffer tank and point on the main refrigeration circuit prior to the expansion device, and the second valve may be in a fluid line between the buffer tank and a point on the main refrigeration circuit after the expansion device.

The measure of sub-cooling may be obtained using a sub-cooling sensor of any suitable type. The refrigeration system may thus include a sub-cooling sensor. The sub-cooling sensor may measure temperature and pressure of the refrigerant fluid within the main refrigeration circuit. The sub-cooling sensor is typically located on the main refrigeration circuit after the heat rejecting heat exchanger and before the expansion device. The refrigeration system may be arranged to use the output signals of the sub-cooling sensor in relation to the control of the valves, such as via a controller as discussed below.

The refrigeration system may be arranged such that when there is excessive sub-cooling then refrigerant fluid is directed into the buffer tank from the main refrigeration circuit, and when there is insufficient sub-cooling then refrigerant fluid is emptied from the buffer tank into the main refrigeration circuit to thereby refill the main refrigeration circuit. The refrigeration system may include a controller for controlling the valves in order to achieve this. This controller may also control other elements within the refrigeration circuit, such as the compression device and/or the expansion device. The controller may receive temperature measurements from sensors, such as a sensor for ambient air temperature (outside air temperature), a sensor for temperature of the temperature controlled space, and/or sensors within with refrigeration circuit such as for measuring temperatures and/or pressures. The sensors may be comprised as a part of the refrigeration system.

With first and second valves as above, the controller may be configured to open the first valve when there is over sub-cooling, with the second valve being closed. The controller may also be configured to open the second valve when there is insufficient sub-cooling, with the first valve being closed. The controller may be arranged such that when it is required to keep the refrigerant charge level of the main circuit unchanged, for example when the sub-cooling is at an optimal value or within a range around an optimal value then both the first valve and second valve will be closed. Hysteresis may be applied to a control loop of the controller. The measurement of sub-cooling can comprise a sub-cooling value, which may be provided by the sub-cooling sensor.

Thus, the controller may be arranged to keep both valves closed when the sub-cooling value stays within a range between an outer, over-sub-cooling, threshold value and an outer, under-sub-cooling, threshold value, where the outer threshold values are above and below an optimal sub-cooling value. The controller may further be arranged to open the first valve, with the second valve closed, if the sub-cooling value exceeds the outer, over-sub-cooling, threshold level, and to open the second valve, with the first valve closed, if the sub-cooling value is below the outer, under-sub-cooling, threshold value. The controller may be arranged to close the respective valve again when the sub-cooling reverts to a value that is within the range. This value may be a certain amount within the range, rather than just inside of the threshold value, such as when using hysteresis in the control of the valves.

Where hysteresis is used then the controller may be arranged to keep the respective valve open until the sub-cooling moves back within the outer range by at least a certain amount, such as going 10% or 20% beyond the threshold value. Thus, after the first valve is opened due to the sub-cooling value exceeding the outer, over-sub-cooling, threshold level, the controller may be arranged to keep it open until the sub-cooling value passes a inner, over-sub-cooling, threshold level, which is a lower value than the outer, over-sub-cooling, threshold value, and then to revert to a state with both valves closed. Similarly, after the second valve is opened due to the sub-cooling value going beneath the outer, under-sub-cooling, threshold level, the controller may be arranged to keep the second valve open until the sub-cooling value passes a inner, under-sub-cooling, threshold level, which is a higher value than the outer, under-sub-cooling, threshold value, and then to revert to a state with both valves closed. The inner threshold levels may both be the optimal sub-cooling value. In that case after opening of the first valve to address over-sub-cooling the first valve may be kept open until the sub-cooling decreases to the optimal value, and then the controller may revert the system to a state with both valves closed, with the second valve, after opening due to under-sub-cooling, being kept open until the sub-cooling increases to the optimal value, after which the controller will revert the system to a state with both valves closed.

When the first and/or second valve is changed between open and closed this may be done gradually to avoid any shock loading on the refrigeration system. Moreover, in some instances the valves may be only partially opened, rather than fully opened depending on system requirements. The first valve may be a relatively simple valve, such as a solenoid valve, with an open state and a closed state. It has been found that in the example embodiment, such as with the first valve controlling fluid flow into the buffer tank from a high pressure side of the expansion device, the opening degree of the first valve is not crucial and therefore opening degree of the first valve need not be subject to any particular control. The second valve may be a valve with a controllable degree of opening, such as a PMV, in order to allow the refrigeration system to vary the degree of opening whilst the refrigerant fluid is being transferred from the buffer tank to the main refrigeration circuit. This control of the second valve may use the controller, where present. The refrigeration system may be arranged to control the degree of opening of the second valve in order to control the amount of liquid refrigerant fluid at an inlet of the compression device, such as to avoid any liquid refrigerant. This control may use sensors to determine the state of the fluid being passed to the compression device and to thereby avoid fluid states resulting in excessive liquid at the compression device inlet. That may involve temperature and/or pressure sensors at the heat absorbing heat exchanger or at the compression device, or in fluid paths between the two.

The compression device may be any suitable device for raising the pressure of the refrigerant fluid, and hence may be a compressor of any suitable type, such as a compressor known for refrigeration circuits. For some types of refrigeration systems the compression device may be a pump. The compression device may be arranged to operate with single phase refrigerant, i.e. fully gaseous refrigerant, or with a two phase refrigerant having a mix of liquid and gas phases. The compression device can have an inlet connected to a fluid pathway from the heat absorbing heat exchanger and an outlet connected to a fluid pathway to the heat rejecting heat exchanger. In some examples the fluid pathways provide a direct connection with no other refrigeration system components that would modify the state of the refrigerant fluid. The compression device may have an intermediate inlet, such as for connection to an economiser line.

The expansion device may be any suitable device for reducing the pressure of the refrigerant fluid, such as an expansion valve, or a separator with an expansion function. The expansion device may be arranged to provide a controllable degree of expansion, such as via use of a valve with a controllable degree of opening. The expansion valve may be an electronic expansion valve. The degree of opening of the expansion valve may be controlled to react to changes in the behaviour of the refrigerant circuit depending on the adjustment of charge level via use of the buffer tank. This control may be done via a controller as above, where present. For an example, to compensate for a pressure drop or pressure increase, the expansion valve may increase or decrease its opening (e.g. under control of the controller) in order to keep the same behaviour of the refrigerant circuit, for example the opening of the expansion valve may be controlled in order to keep the same refrigerant mass flow through the circuit.

The main refrigeration circuit may include an economiser line. The economiser line may be connected to or interact with the expansion device. The economiser line may extend to the intermediate inlet of the compressor from a branch point in the main refrigeration circuit after the heat rejection heat exchanger and prior to, or at, the expansion device. There may be an economiser valve in the economiser line for economised expansion and for control of the degree of economiser flow, as well as an economiser heat exchanger for heat exchange between refrigerant fluid in the economiser line after the economiser valve and refrigerant fluid in the main refrigeration circuit after the branch point and prior to the expansion device.

The heat absorbing heat exchanger may be an evaporator. The heat rejection heat exchanger may be a condenser.

Viewed from a second aspect, the invention extends to a method for operating a refrigeration system, where the method may comprise use of the refrigeration system of the first aspect. Thus, the method may be a method for operating a refrigeration system comprising: a main refrigeration circuit for holding refrigerant fluid, the main refrigeration circuit including: a compression device, a heat rejecting heat exchanger, an expansion device and a heat absorbing heat exchanger; wherein the refrigeration system includes a buffer tank attached to the main refrigeration circuit, with valves for controlling flow of refrigerant fluid between the main refrigeration circuit and the buffer tank; the method comprising controlling the valves to transfer refrigerant fluid between the main refrigeration circuit and the buffer tank based on a measure of sub-cooling in the main refrigeration circuit.

The method may include the use of a refrigeration system having other features as discussed above in connection with optional features of the first aspect.

The controlling of the valves may be done to vary the refrigerant charge level of the main refrigeration circuit in order to allow for one or more of increased efficiency during changes in operating conditions, an enlarged operating envelope of the refrigerant system, and/or adjustments as refrigerant charge is depleted over time.

The buffer tank may be connected to the main refrigeration circuit via a first valve for controlling flow to or from a higher pressure point on the refrigerant circuit and a second valve for controlling flow to or from a lower pressure point on the refrigerant circuit, wherein the method comprises, when a refrigerant pressure in the buffer tank is lower or higher than a refrigerant pressure in the main refrigeration circuit, opening the respective valve to allow for transfer of refrigerant fluid to or from the buffer tank. For example, when it is desired to decrease charge levels in the main refrigeration circuit then the first valve may be opened to fill the buffer tank from the higher pressure point, and when it is desired to increase charge levels in the main refrigeration circuit then the second valve may be opened to empty the buffer tank to the lower pressure point. The buffer tank may be connected to the main refrigeration circuit in parallel with the expansion device as discussed above.

The method may include obtaining the measure of sub-cooling by using a sub-cooling sensor, which may be a sensor of any suitable type, and may measure temperature and pressure of the refrigerant fluid within the main refrigeration circuit. The sub-cooling sensor may be located on the main refrigeration circuit after the heat rejecting heat exchanger and before the expansion device. The method may include using the output signals of the sub-cooling sensor in relation to the control of the valves, via a controller as discussed above.

Example embodiments of the method include controlling the valves for directing refrigerant fluid into the buffer tank from the main refrigeration circuit when there is excessive sub-cooling, and directing refrigerant fluid from the buffer tank into the main refrigeration circuit when there is insufficient sub-cooling.

In one example, with first and second valves as above, the method includes opening the first valve when there is over sub-cooling, with the second valve being closed. The method may also include opening the second valve when there is insufficient sub-cooling, with the first valve being closed. When it is required to keep the refrigerant charge level of the main circuit unchanged, for example when the sub-cooling is at an optimal value or within a range around an optimal value then both the first valve and second valve may be closed.

The method may include: keeping both valves closed when a sub-cooling value stays within a range between an outer, over-sub-cooling, threshold value and an outer, under-sub-cooling, threshold value, where the outer threshold values are above and below an optimal sub-cooling value; opening the first valve, with the second valve closed, if the sub-cooling value exceeds the outer, over-sub-cooling, threshold level; and opening the second valve, with the first valve closed, if the sub-cooling value is below the outer, under-sub-cooling, threshold value. The opened valve may be closed again when the sub-cooling reverts to a value that is within the range.

The method may include hysteresis in relation to opening and closing of the valves, and in that case, the method may include keeping the opened valve open until the sub-cooling moves back within the outer range by at least a certain amount, such as going 10% or 20% beyond the threshold value. Thus, after the first valve is opened due to the sub-cooling value exceeding the outer, over-sub-cooling, threshold level, the valve may be kept open until the sub-cooling value passes a inner, over-sub-cooling, threshold level, which is a lower value than the outer, over-sub-cooling, threshold value, and then both valves may be closed. Similarly, after the second valve is opened due to the sub-cooling value going beneath the outer, under-sub-cooling, threshold level, the second valve may be kept open until the sub-cooling value passes a inner, under-sub-cooling, threshold level, which is a higher value than the outer, under-sub-cooling, threshold value, and then to revert to a state with both valves closed. The inner threshold levels may both be the optimal sub-cooling value. In that case after opening of the first valve to address over-sub-cooling the first valve may be kept open until the sub-cooling decreases to the optimal value, and then the controller may revert the system to a state with both valves closed, with the second valve, after opening due to under-sub-cooling, being kept open until the sub-cooling increases to the optimal value, after which both valves are closed.

When the first and/or second valve is changed between open and closed this may be done gradually to avoid any shock loading on the refrigeration system. Moreover, in some instances the valves may be only partially opened, rather than fully opened depending on system requirements. The first valve may be a relatively simple valve, such as a solenoid valve, with an open state and a closed state. The second valve may be a valve with a controllable degree of opening, such as a PMV, and the method may include varying the degree of opening whilst the refrigerant fluid is being transferred from the buffer tank to the main refrigeration circuit. The degree of opening of the second valve may be controlled in order to control the amount of liquid refrigerant fluid at an inlet of the compression device, such as to avoid any liquid refrigerant being present. The method may include using sensors to determine the state of the fluid being passed to the compression device and to thereby avoid fluid states resulting in excessive liquid at the compression device inlet. That may involve temperature and/or pressure sensors at the heat absorbing heat exchanger or at the compression device, or in fluid paths between the two.

The compression device may be any suitable device as discussed above. Optionally the method includes passing refrigerant fluid directly from the heat absorbing heat exchanger to the compressor and/or passing refrigerant fluid directly from the compressor to the heat rejecting heat exchanger. The method may use fluid pathways providing a direct connection with no other refrigeration system components that would modify the state of the refrigerant fluid. Optionally, an economiser may be included and used within the refrigeration system as discussed above.

The expansion device may be any suitable device for reducing the pressure of the refrigerant fluid as discussed above. The method may include controlling the degree of expansion of refrigerant fluid at the expansion device, such as by using a valve with a controllable degree of opening. The degree of opening of the expansion valve may be controlled to react to changes in the behaviour of the refrigerant circuit depending on the adjustment of charge level via use of the buffer tank.

BRIEF DESCRIPTION OF THE DRAWINGS

Certain preferred embodiments of the present invention will now be described, by way of example only, with reference to the following drawings, in which.

DETAILED DESCRIPTION

Figure 1:
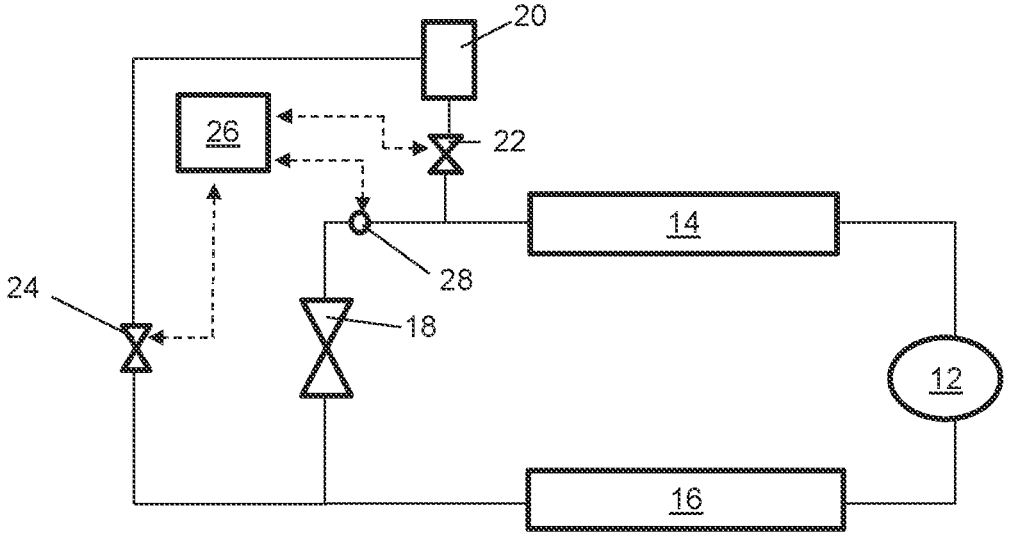
FIG. 1 is a schematic diagram for a refrigeration system using a main refrigeration circuit and a buffer tank connected to the main refrigeration circuit.

As seen in FIG. 1, a refrigeration system includes a compression device 12, a heat rejecting heat exchanger 14, an expansion device 18 and a heat absorbing heat exchanger 16 that together form a main refrigeration circuit. The main refrigeration circuit contains a refrigerant fluid and circulation of the refrigerant fluid via the compression device 12 enables the refrigeration system to utilise a refrigeration cycle (or heat pump cycle) to satisfy a cooling (or heating) load. In this example the compression device 12 is a compressor 12 for compression of gaseous refrigerant fluid, the heat rejecting heat exchanger 14 is a condenser for at least partially condensing the refrigerant fluid, the expansion device 18 is an expansion valve for expanding the refrigerant fluid, and the heat absorbing heat exchanger 16 is an evaporator for at least partially evaporating the refrigerant fluid. The refrigeration system may advantageously be arranged so that the fluid is fully condensed at the condenser 14, and fully evaporator at the evaporator 16. In many cases it is beneficial to avoid the presence of liquid at the inlet to the compressor 12.

The example refrigeration system further includes a buffer tank 20 attached to the main refrigerant circuit in parallel with the expansion device 18. The buffer tank 20 provides a receiver/reservoir for the refrigerant fluid and is connected to the main refrigeration circuit via a first valve 22 for controlling flow to or from a higher pressure point on the refrigerant circuit and a second valve 24 for controlling flow to or from a lower pressure point on the refrigerant circuit. As shown in FIG. 1, in this example the buffer tank 20 is connected to the main refrigeration circuit in parallel with the expansion device 18, with fluid connections via the first valve 22 to a higher pressure point prior to expansion, and via the second valve 24 to a lower pressure point after expansion.

The valves 22, 24 are controlled by a controller 26 in order to control the flow of refrigerant fluid between the main refrigerant circuit and the buffer tank 20. The controller 26 can also be used for control of other elements of the refrigeration system, such as the compressor 12. The valves 20, 22 are controlled to transfer refrigerant fluid between the main refrigerant circuit and the buffer tank 20 based on a measure of sub-cooling obtained from a sub-cooling sensor 28 in the main refrigerant circuit. In this example the sub-cooling sensor 28 is placed on a refrigerant fluid pathway between the heat rejecting heat exchanger (condenser) 14 and the expansion device (expansion valve) 18.

When a refrigerant pressure in the buffer tank 20 is lower or higher than a refrigerant pressure in the main refrigeration circuit then opening the respective valve 22, 24 will allow for transfer of refrigerant fluid to or from the buffer tank 20. For example, when it is desired to decrease charge levels in the main refrigeration circuit then the first valve 22 may be opened to fill the buffer tank 20 from the higher pressure point, and when it is desired to increase charge levels in the main refrigeration circuit then the second valve 24 may be opened to empty the buffer tank 20 to the lower pressure point. The first valve 22 is a solenoid valve 22, with an open state and a closed state. The second valve 24 is a valve 24 with a controllable degree of opening, such as a PMV 24, in order to allow the controller 26 to vary the degree of opening whilst the refrigerant fluid is being transferred from the buffer tank 20 to the main refrigeration circuit. The controller 26 can control the degree of opening of the second valve 24 in order to control the amount of liquid refrigerant fluid at an inlet of the compressor 12, such as to avoid any liquid refrigerant that may damage the compressor 12.

The refrigerant charge level is varied using the valves 22, 24 in order to control the sub-cooling within the main refrigerant circuit, as assessed through a sub-cooling value obtained via the sub-cooling sensor 28. In case of over-sub-cooling, the controller opens the first valve 22 to reduce the refrigerant charge. Some refrigerant will be stored into the receiver/buffer tank 20. In case of a low sub-cooling value, the second valve 24 is opened so that the main refrigerant circuit will be refilled from the buffer tank 20. As noted above, the degree of opening of the second valve 24 can be controlled, such as via a PMV 24, in order to avoid liquid at the compressor suction inlet. The thresholds for opening and closing the first and second valves 22, 24 are based on a sub-cooling curve optimisation that allows for varying refrigerant charge depending on the condition and unit load. This gives various advantages as discussed above, including increased efficiency and the potential for an enlarged operating envelope. It also increases the available refrigerant charge and allows for corrections to maintain effective operation as the refrigeration charge levels decrease over time, i.e. during use of the refrigerant system. A further advantage of this is a reduced maintenance burden.

Figure 2:
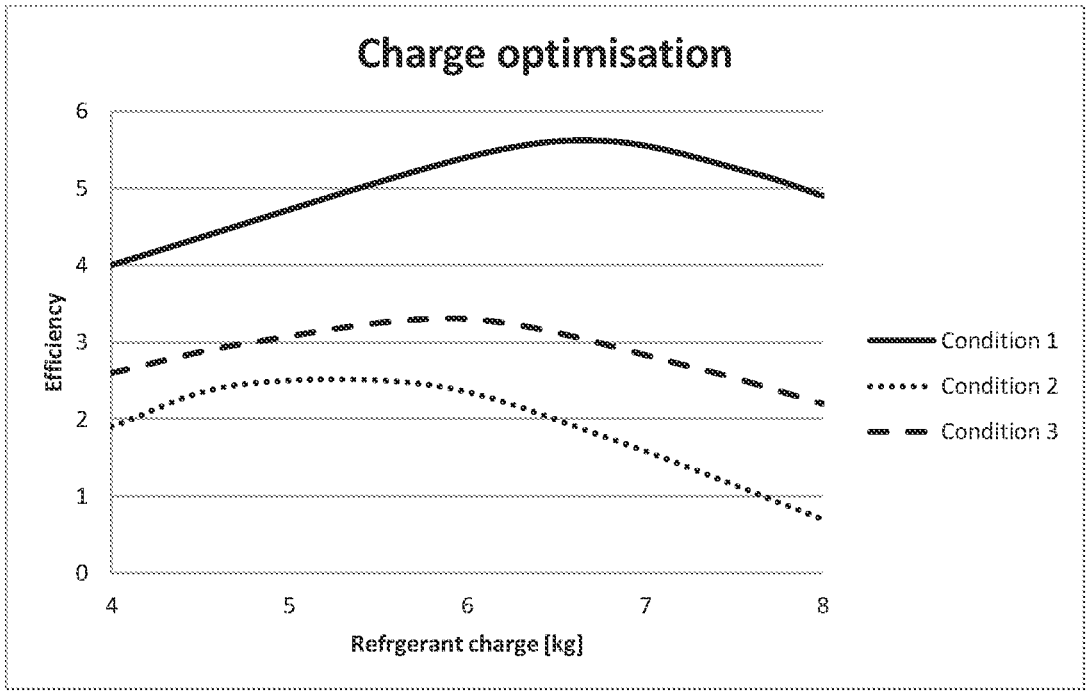
FIG. 2 shows example plots of efficiency against charge level for various operating conditions.

It has been realised that a better control of optimal performance can be achieved by allowing for a varying refrigerant charge level controlled depending on the sub-cooling within the main refrigeration circuit. As is known, an optimal sub-cooling value will exist for a given refrigeration circuit, dependent on various factors including the specification of the compression device and the superheat value selected for the expansion device 18 (typically a fixed value). Operating at the optimal sub-cooling value will result in the maximum efficiency for the refrigeration circuit. It is possible to assess the refrigerant charge level required to achieve this optimum. FIG. 2 shows sample curves of efficiency against refrigerant charge level for three different operating conditions, such as operating conditions relating to differing internal or external temperature.

In a typical refrigeration system, absent the buffer tank 20 proposed herein, the refrigerant charge level is optimised for one specific condition, such as by identifying a peak on the relevant curve of FIG. 2. However, this generally involves a compromise in which the charge level is set based on an estimate of the most likely condition, and/or by assessing a central condition within a range of operating conditions. In real world operation, the refrigeration system will operate at many different conditions, with different external temperatures and different loads during operation. For all those conditions that vary from the assumed operating condition, the performance of the refrigeration system is not optimised in relation to the refrigerant charge level. As a consequence, prior systems always involve a compromise, for example by deciding on a refrigerant charge of 6 kg. This would be ideal for Condition 3, but the refrigeration system would lose 10% efficiency for condition 1 and 5% for condition 2 versus the most optimum value for those conditions. With the use of a buffer tank 20 as discussed above, the controller 26 can adjust the refrigerant charge via use of the valves 22, 24 in order to fit the refrigerant charge level to the optimum values for different operating conditions. The controller 26 may use any suitable control system to vary the refrigerant charge level with the target of keeping the sub-cooling value at the sub-cooling sensor at the optimal level, which will hence then adjust the refrigerant charge levels to track the peak efficiency values shown an FIG. 2 as the operating conditions vary. As discussed above, the controller 26 may allow for some hysteresis with respect to threshold values using during control of the valves 22, 24. Other control systems may also be present.

The refrigeration system may include other elements not shown in FIG. 1, such as an economiser line or other more complex additions to the refrigeration circuit, such as in order adapt a refrigeration cycle for particular requirements. The refrigeration system may operate for satisfying a cooling load, or it may be used as a heat pump to provide heating.

What is claimed is:

1. A refrigeration system comprising:

a main refrigeration circuit for holding refrigerant fluid, the main refrigeration circuit including: a compression device, a heat rejecting heat exchanger, an expansion device and a heat absorbing heat exchanger;

a sub-cooling sensor for obtaining the measure of sub-cooling;

wherein the refrigeration system includes a buffer tank attached to the main refrigeration circuit, with valves for controlling flow of refrigerant fluid between the main refrigeration circuit and the buffer tank;

a controller configured to control the valves; and wherein the refrigeration system is arranged such that the valves are controlled by the controller to transfer refrigerant fluid between the main refrigeration circuit and the buffer tank based on a measure of sub-cooling in the main refrigeration circuit;

wherein the valves comprise a first valve for controlling flow to or from a higher pressure point on the refrigerant circuit, and a second valve for controlling flow to or from a lower pressure point on the refrigerant circuit;

wherein the second valve is a valve with a controllable degree of opening and the controller is configured to vary the degree of opening whilst the refrigerant fluid is being transferred from the buffer tank to the main refrigeration circuit;

wherein the controller is configured to control the degree of opening of the second valve is used in order to control the amount of liquid refrigerant fluid at an inlet of the compression device such as to avoid any liquid refrigerant that may damage the compression device.

2. A refrigeration system as claimed in claim 1, wherein the buffer tank is connected to the main refrigeration circuit in parallel with the expansion device, with fluid connections to a higher pressure point prior to expansion, and a lower pressure point after expansion.

3. A refrigeration system as claimed in claim 1, wherein the sub-cooling sensor is located on the main refrigeration circuit after the heat rejecting heat exchanger and before the expansion device.

4. A refrigeration system as claimed in claim 1, comprising a controller for controlling the valves, wherein the controller is configured such that when the measure of sub-cooling indicates there is excessive sub-cooling then refrigerant fluid is directed into the buffer tank from the main refrigeration circuit, and when there is insufficient sub-cooling then refrigerant fluid is emptied from the buffer tank into the main refrigeration circuit to thereby refill the main refrigeration circuit.

5. A refrigeration system as claimed in claim 1, wherein the refrigeration system is arranged such that when it is desired to decrease charge levels in the main refrigeration circuit then the first valve is opened to fill the buffer tank from the higher pressure point, and when it is desired to increase charge levels in the main refrigeration circuit then the second valve is opened to empty the buffer tank to the lower pressure point.

6. A refrigeration system as claimed in claim 1, wherein the expansion device is arranged to provide a controllable degree of expansion, and the refrigeration system is arranged to control the degree of opening of the expansion valve in reaction to changes in the behaviour of the refrigerant circuit.

7. A method for operating a refrigeration system as claimed in claim 1, the method comprising controlling the valves to transfer refrigerant fluid between the main refrigeration circuit and the buffer tank based on a measure of sub-cooling in the main refrigeration circuit.

8. A method as claimed in claim 7, wherein controlling of the valves is done to vary the refrigerant charge level of the main refrigeration circuit in order to allow for one or more of: increased efficiency during changes in operating conditions, an enlarged operating envelope of the refrigerant system, and/or adjustments as refrigerant charge is depleted over time.

9. A method as claimed in claim 7, including controlling the valves for directing refrigerant fluid into the buffer tank from the main refrigeration circuit when there is excessive sub-cooling, and for directing refrigerant fluid from the buffer tank into the main refrigeration circuit when there is insufficient sub-cooling.

10. A method as claimed in claim 7, including:

when there is over-sub-cooling, opening a first valve with a second valve being closed;

when there is insufficient sub-cooling, opening the second valve with the first valve being closed; and when it is required to keep the refrigerant charge level of the main circuit unchanged, keeping both the first valve and second valve closed.

11. A method as claimed in claim 7, including varying the degree of opening of the respective valve whilst the refrigerant fluid is being transferred from the buffer tank to the main refrigeration circuit in order to control the amount of liquid refrigerant fluid at an inlet of the compression device.

12. A refrigeration system as claimed in claim 1, wherein the first valve is connected to the main refrigeration circuit between the heat rejecting heat exchanger and the expansion device and the second valve is connected to the main refrigeration circuit between the expansion device and the heat absorbing heat exchanger.

* * * * *